US009843108B2

(12) United States Patent
Le et al.

(10) Patent No.: US 9,843,108 B2
(45) Date of Patent: Dec. 12, 2017

(54) DUAL-FEED DUAL-POLARIZED ANTENNA ELEMENT AND METHOD FOR MANUFACTURING SAME

(71) Applicant: Futurewei Technologies, Inc., Plano, TX (US)

(72) Inventors: Tho Le, Trabuco Canyon, CA (US); Alexis Pierides, Piscataway, NJ (US); Leonard Piazzi, Denville, NJ (US); Zhengxiang Ma, Summit, NJ (US)

(73) Assignee: Futurewei Technologies, Inc., Plano, TX (US)

( * ) Notice: Subject to any disclaimer, the term of this patent is extended or adjusted under 35 U.S.C. 154(b) by 208 days.

(21) Appl. No.: 14/603,034

(22) Filed: Jan. 22, 2015

(65) Prior Publication Data

US 2016/0028166 A1 Jan. 28, 2016

Related U.S. Application Data

(60) Provisional application No. 62/029,296, filed on Jul. 25, 2014.

(51) Int. Cl.

| | |
|---|---|
| ***H01Q 21/26*** | (2006.01) |
| ***H01Q 21/24*** | (2006.01) |
| ***H01Q 21/06*** | (2006.01) |
| *H01Q 1/38* | (2006.01) |

(Continued)

(52) U.S. Cl.

CPC ..... *H01Q 21/24* (2013.01); *H01Q 21/062* (2013.01); *H01Q 1/246* (2013.01); *H01Q 1/38* (2013.01); *H01Q 21/0087* (2013.01)

(58) Field of Classification Search

CPC ..... H01Q 21/24; H01Q 21/062; H01Q 1/246; H01Q 1/38

See application file for complete search history.

(56) References Cited

U.S. PATENT DOCUMENTS 4,649,391 A * 3/1987 Tsuda ..... H01Q 25/02 342/153
5,223,848 A * 6/1993 Rammos ..... H01Q 9/0407 343/700 MS (Continued)

FOREIGN PATENT DOCUMENTS

CN 1591976 A 3/2005
CN 201199545 Y 2/2009

(Continued)

OTHER PUBLICATIONS

International Search Report and Written Opinion received in Application No. PCT/CN2015/085076 dated Oct. 29, 2015, 11 pages.

*Primary Examiner* — Trinh Dinh
(74) *Attorney, Agent, or Firm* — Slater Matsil, LLP

(57) ABSTRACT

Disclosed herein is a dual-feed dual-polarized antenna element and a method for manufacturing the same. An embodiment dual-polarization antenna element includes four radiating elements and eight feed ports. The four radiating elements are arranged in a co-planar diamond pattern. The neighboring elements of the four radiating elements form four shared-element dipole antenna elements. Each of the four radiating elements is shared between two cross-polarized dipole antenna elements of the four shared-element dipole antenna elements. The eight feed ports are arranged in four cross-polarized dual-feed pairs respectively disposed on the four radiating elements. Each feed port of the four cross-polarized dual-feed pairs is operable to respectively excite one of the four radiating elements for a cross-polarized one of the four shared-element dipole antenna elements.

33 Claims, 8 Drawing Sheets

(51) Int. Cl.
*H01Q 21/00* (2006.01)
*H01Q 1/24* (2006.01)

(56) References Cited

U.S. PATENT DOCUMENTS

| | | | | |
|---|---|---|---|---|
| 5,926,137 | A | 7/1999 | Nealy | |
| 6,072,439 | A | 6/2000 | Ippolito et al. | |
| 6,195,063 | B1 | 2/2001 | Gabriel et al. | |
| 6,529,172 | B2 | 3/2003 | Zimmerman | |
| 6,747,606 | B2 | 6/2004 | Harel et al. | |
| 6,940,465 | B2 | 9/2005 | Gottl et al. | |
| 9,391,375 | B1 * | 7/2016 | Bales | H01Q 21/24 343/753 |
| 2007/0046558 | A1 | 3/2007 | Tillery | |
| 2007/0080883 | A1 * | 4/2007 | Boss | H01Q 9/06 343/797 |
| 2007/0205955 | A1 * | 9/2007 | Korisch | H01Q 1/246 343/853 |
| 2009/0058725 | A1 * | 3/2009 | Barker | H04B 7/0408 342/372 |
| 2013/0234908 | A1 * | 9/2013 | Howard | H01Q 1/523 343/853 |
| 2014/0071006 | A1 | 3/2014 | Chan et al. | |
| 2015/0188236 | A1 * | 7/2015 | Oppenlaender | H01Q 13/02 343/776 |
| 2016/0226156 | A1 | 8/2016 | So et al. | |

FOREIGN PATENT DOCUMENTS

| | | | |
|---|---|---|---|
| CN | 102683825 | A | 9/2012 |
| CN | 203071222 | U | 7/2013 |

* cited by examiner

DUAL-FEED DUAL-POLARIZED ANTENNA ELEMENT AND METHOD FOR MANUFACTURING SAME

This application claims the benefit of U.S. Provisional Application No. 62/029,296, filed on Jul. 25, 2014, entitled "Dual-Feed Dual-Polarized Antenna Element and Method for Manufacturing Same," which application is hereby incorporated herein by reference.

TECHNICAL FIELD

The present invention relates generally to a dual-polarized antenna, and, in particular embodiments, to a dual-feed dual-polarized antenna element and method of manufacturing the same.

BACKGROUND

A variety of antennas are used in radar, telecommunications, and other radio frequency (RF) systems. One common type of antenna is a dipole antenna, the most common of which is the half-wave dipole antenna. A half-wave dipole antenna is formed by two quarter-wavelength conductors, or elements, placed back-to-back for a total length of one-half wavelength. A standing wave on an element of one-half wavelength in length yields the greatest voltage differential, as one end of the element is at a node of the wave, and the other is at an antinode of the wave. The larger the voltage differential between the dipole elements, the greater the current between the dipole elements. The current is distributed along the length of the dipole, causing it to radiate an electric field (E-field) and a magnetic field (H-field). The direction of the E-field, represented by an E-field vector, is referred to as the polarization of the antenna.

Some RF systems utilize dual-polarization, or dual-polarized, antennas. For example, in the telecommunications industry, dual-polarization antennas are often found in base-station systems. A dual-polarized antenna can radiate in two directions within the E-field plane (E-plane), sometimes referred to as the polarization plane. In each direction, the generated E-field is polarized from the other and the two polarizations are typically orthogonal in the E-plane. Orthogonal polarizations ideally prevent power from one polarization from bleeding into another, which, when measured, is referred to as cross-polarization isolation or cross-polarization discrimination. However, polarizations can vary from perfectly orthogonal and therefore create power inefficiencies in the RF system caused by power transfer between polarizations.

Dual-polarized dipole antennas can be formed by arranging two linear-polarized antenna elements in a way that creates dual polarization. For example, a dual-polarized dipole antenna can be formed with one dipole antenna element rotated 90 degrees in the E-plane from another dipole antenna element. Each polarization need not be vertical or horizontal, in fact, it is common in the telecommunications industry to use plus-or-minus 45 degree, or slant, polarization, where the 45 degree offset of each polarization is with respect to the vertical or horizontal. In certain RF systems, the dual-polarized dipole antenna is duplicated to form an array that allows multiple simultaneous transmission and reception.

SUMMARY OF THE INVENTION

Embodiments of the present invention provide a dual-polarized antenna having shared-element dipole antenna elements. In certain embodiments, the dual-polarized antenna is operable to produce stable azimuth beam width, high bandwidth, and good cross-polarization isolation in a small profile with the benefit of low cost manufacturing.

An embodiment dual-polarization antenna element includes four radiating elements and eight feed ports. The four radiating elements are arranged in a co-planar diamond pattern. The neighboring elements of the four radiating elements form four shared-element dipole antenna elements. Each of the four radiating elements is shared between two cross-polarized dipole antenna elements of the four shared-element dipole antenna elements. The eight feed ports are arranged in four cross-polarized dual-feed pairs respectively disposed on the four radiating elements. Each feed port on the four radiating elements excites at least one of the cross-polarized dipole antenna elements.

An embodiment dual-feed dual-polarized ultra wide band (UWB) antenna includes four radiating elements, a dual-feed network, and a circuit. The four radiating elements form four shared-element dipole antenna elements arranged in a co-planar diamond pattern. The four shared-element dipole antenna elements include two shared-element dipole antenna elements cross-polarized with respect to two others. Each shared-element dipole antenna element is composed of two radiating elements of the four radiating elements, and each of those two radiating elements is shared with a respective cross-polarized shared-element dipole antenna element of the four shared-element dipole antenna elements. The dual-feed network includes four feeds respectively coupled to neighboring pairs of radiating elements of the four radiating elements. Each of the four radiating elements is respectively coupled to two cross-polarized feeds of the four feeds. The circuit includes first and second dipole feed circuits respectively coupled to opposingly-arranged similarly-polarized feeds, of the four feeds.

An embodiment method for manufacturing a dual-feed dual-polarized antenna element includes forming four radiating elements and forming eight feed ports. The four radiating elements are arranged in a co-planar diamond pattern. The neighboring elements of the four radiating elements form four shared-element dipole antenna elements. Each of the four radiating elements is shared between two cross-polarized dipole antenna elements of the four shared-element dipole antenna elements. The eight feed ports are arranged in four cross-polarized dual-feed pairs respectively disposed on the four radiating elements. Each feed port on the four radiating elements is disposed to excite at least one of the cross-polarized dipole antenna elements.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF ILLUSTRATIVE EMBODIMENTS

The making and using of embodiments are discussed in detail below. It should be appreciated, however, the present disclosure provides many inventive concepts that may be embodied in a wide variety of contexts. The specific embodiments discussed herein are merely illustrative of ways to make and use various embodiments of this disclosure, and do not limit the scope of the disclosure.

Disclosed herein is an ultra wide band (UWB) dipole antenna with dual-polarization can be made with stable −3 dB azimuth beamwidth and good cross-polarization isolation. UWB antennas are used for transmitting over a large bandwidth, typically 500 megahertz (MHz) or larger. For a given frequency band, the wavelength is the wavelength for the center frequency in the band. Certain dipole antennas use two narrow quarter-wavelength conductors as elements, which yields a narrow bandwidth antenna. A UWB dipole antenna requires a larger antenna surface to achieve the wide bandwidth. The dual-polarized dual-fed UWB antenna element introduced herein uses quarter-wavelength elements having an area equal to a quarter-wavelength, or λ/4. Wavelength, λ, is defined as follows, $$\lambda = \frac{C}{f_{center}\sqrt{\varepsilon_{eff}}},$$

where, C is the speed of light, $f_{center}$ is the center frequency of the band, and $\in_{eff}$ is the effective dielectric constant for a given element. Additionally, it is realized herein, four dipole antenna elements can be provided with four radiating elements by forming shared-element dipole antenna elements. By reducing the typical element count from eight to four, fabrication, cost, and size can be reduced. A shared-element dipole antenna element excites each antenna element in such a way that current distribution over the radiating elements for each dipole does not bleed into the cross-polarized dipole. The shared-element dipole antenna element is fed by a dual-feed network that is operable to excite each radiating element for two orthogonal polarizations. The dual-feed network couples to the radiating elements via feed ports. It is realized herein the location of the feed ports on the radiating elements is a function of the wavelength and target impedance of the elements.

Figure 1:
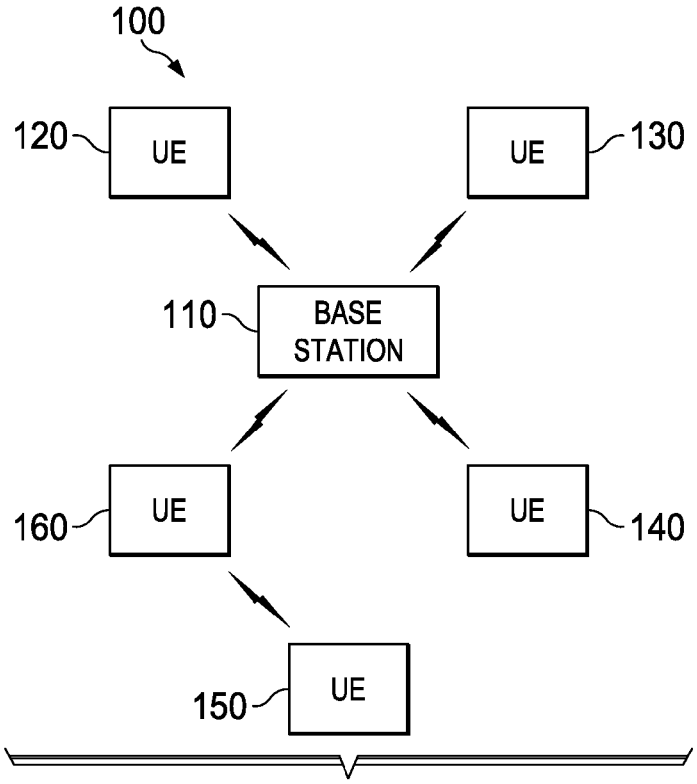
FIG. 1 is a block diagram of one embodiment of a wireless communication system.

FIG. 1 is a block diagram of one embodiment of a wireless communication system 100. Wireless communication system 100 includes a base station 110 within which the dual-feed dual-polarization UWB antenna element introduced herein may be embodied. Base station 110 serves one or more User Equipment (UE) devices, such as UE 120, UE 130, UE 140, and UE 150, by receiving communications originating from the UE devices and forwarding the communications to their respective intended destinations, or by receiving communications destined for the UE devices and forwarding the communications to their respective intended UE devices. Some UE devices can communicate directly with one another as opposed to communicating through base station 110. For example, in the embodiment of FIG. 1, a UE 160 transmits directly to UE 150, and vice versa. Base station 110 is sometimes referred to as an access point, a NodeB, an evolved NodeB (eNB), a controller, or a communication controller. UEs 120 through 160 are sometimes referred to as stations, mobile stations, mobiles, terminals, users, or subscribers.

Figure 2:
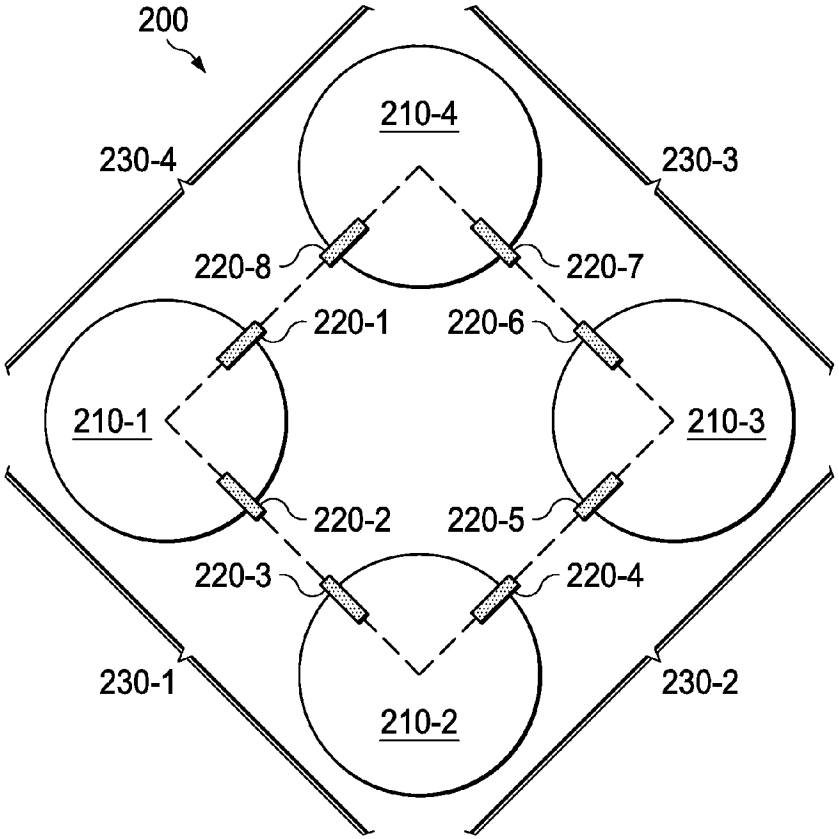
FIG. 2 is an illustrative diagram of one embodiment of a dual-polarization antenna element.

FIG. 2 is an illustrative diagram of one embodiment of a dual-polarization antenna element 200. Antenna element 200 includes four radiating elements: element 210-1, element 210-2, element 210-3, and element 210-4. Antenna element 200 also includes eight feed ports, port 220-1 through port 220-8.

The four radiating elements are arranged in a co-planar diamond pattern. The plane of the diamond pattern is also the plane of the E-field, or the E-plane. The E-plane is also referred to as the polarization plane. The four radiating elements are circle-shaped and sized according to the wavelength of antenna element 200. The four radiating elements are quarter-wavelength elements, such that a dipole antenna element containing two radiating elements is a half-wavelength dipole antenna element. The size of each of the four radiating elements can be computed such that the area of each radiating element is equal to λ/4. Neighboring pairs of the four radiating elements form shared-element dipole antenna elements. Element 210-1 neighbors element 210-2 and element 210-4. Element 210-1 and element 210-2 form shared-element dipole antenna element 230-1. Likewise, element 210-2 and element 210-3 form shared-element dipole antenna element 230-2, element 210-3 and element 210-4 form shared-element dipole antenna element 230-3, and element 210-4 and element 210-1 form shared-element dipole antenna element 230-4. Each of the four radiating elements is shared between two cross-polarized shared-element dipole antenna elements. For example, element 210-3 is shared between shared-element dipole antenna element 230-2 and shared-element dipole antenna element 230-3. Shared-element dipole antenna element 230-2 is polarized roughly 45 degrees clockwise from vertical. Shared-element dipole antenna element 230-3 is polarized roughly −45 degrees clockwise from vertical, or 45 degrees counter-clockwise. The two elements are orthogonally polarized, or cross-polarized. Furthermore, antenna element 200 includes two shared-element dipole antenna elements that are cross-polarized with respect to the other two shared-element dipole antenna elements. In the embodiment of FIG. 2, shared-element dipole antenna elements 230-2 and 230-4 are cross-polarized with respect to shared-element dipole antenna elements 230-1 and 230-3. In alternative embodiments, polarizations may be rotated toward the vertical or toward the horizontal. However, the dual-polarization should be orthogonal.

Feed ports 220-1 through 220-8 are arranged in cross-polarized dual-feed pairs. The four cross-polarized dual-feed pairs are port 220-1 and 220-2, port 220-3 and 220-4, port 220-5 and 220-6, and port 220-7 and 220-8. Each cross-polarized dual-feed pair is disposed on one of the four radiating elements. Port 220-1 and 220-2 are disposed on element 210-1, port 220-3 and 220-4 are disposed on element 210-2, port 220-5 and 220-6 are disposed on element 210-3, and port 220-7 and 220-8 are disposed on element 210-4. Feed ports 220-1 through 220-8 are operable to excite each of the four radiating elements of antenna element 200. Each feed port of the cross-polarized dual-feed pair is configured to excite its respective radiating element for a cross-polarized one of the shared-element dipole antenna elements. For example, in the embodiment of FIG. 2, consider element 210-2, on which feed port 220-3 and feed port 220-4 are disposed. Element 210-2 is an element of shared-element dipole antenna element 230-1 and shared-element dipole antenna element 230-2. Feed port 220-3 is operable to excite element 210-2 for shared-element dipole antenna element 230-2. Likewise, feed port 220-4 is operable to excite element 210-2 for shared-element dipole antenna element 230-1. These excitations are cross-polarized, as are shared-element dipole antenna element 230-1 and shared-element dipole antenna element 230-2. In the embodiment of FIG. 2, the feed ports are rectangular contacts suitable for a connection to a PCB feed network. In alternative embodiments, the feed ports can be circular and better suited for coaxial connection to a feed network.

Continuing the embodiment of FIG. 2, each of the shared-element dipole antenna elements is excited by two feed ports of feed ports 220-1 through 220-8. Shared-element dipole antenna element 230-1, having element 210-1 and element 210-2, is configured to be excited through feed port 220-1 and 220-4. Shared-element dipole antenna element 230-2, having element 210-2 and element 210-3, is configured to be excited through feed port 220-3 and 220-6. Shared-element dipole antenna element 230-3, having element 210-3 and element 210-4, is configured to be excited through feed port 220-5 and 220-8. Finally, shared-element dipole antenna element 230-4, having element 210-4 and element 210-1, is configured to be excited through feed port 220-7 and 220-2.

The location of each of feed ports 220-1 through 220-8 on their respective radiating elements is determined according to the wavelength for antenna element 200 and the target impedance for each radiating element. The distance between feed ports within a shared-element dipole antenna element can, in one embodiment, be calculated according to the dimensions of the radiating elements, which is a function of the $\lambda/4$ element area and the element shape, and the spacing between neighboring radiating elements. Neighboring radiating elements, for example element 210-2 and 210-3, are spaced such that their common feed ports, feed port 220-4 and feed port 220-5, achieve the target impedance for the radiating elements when connected to a feed network. In the embodiment of FIG. 2, feed port 220-4 and feed port 220-5 are separated by $\lambda/32$. The same is true for feed ports 220-6 and 220-7, feed ports 220-8 and 220-1, and feed ports 220-2 and 220-3.

Figure 3:
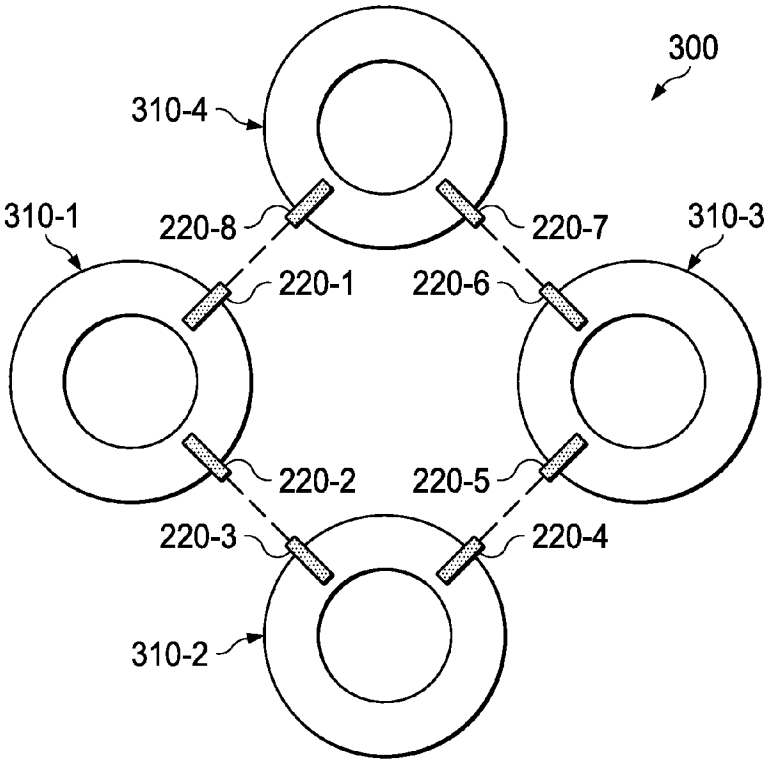
FIG. 3 is an illustrative diagram of another embodiment of a dual-polarization antenna element.

FIG. 3 is an illustrative diagram of another embodiment of a dual-polarization antenna element 300. Antenna element 300 operates like antenna element 200 of FIG. 2, and is similar in shape. Antenna element 300 includes four radiating elements: element 310-1, element 310-2, element 310-3, and element 310-4. Additionally, antenna element 300 includes feed ports 220-1 through 220-8 of FIG. 2. The four radiating elements of antenna element 300 are arranged in a co-planar diamond pattern, as is the case in the embodiment of FIG. 2. The four radiating elements are circular-ring shaped, having a conductive outer ring and a dielectric inner. In certain embodiments the dielectric inner is a PCB substrate. In other embodiments the dielectric inner can be air. The respective areas of each of the conductive outer rings of the four radiating elements are equal to $\lambda/4$. Feed ports 220-1 through 220-8 are disposed on the conductive outer rings of the four radiating elements. Feed ports 220-1 and 220-2 are disposed on element 310-1, feed ports 220-3 and 220-4 are disposed on element 310-2, feed ports 220-4 and 220-6 are disposed on element 310-3, and feed ports 220-7 and 220-8 are disposed on element 310-4.

Figure 4:
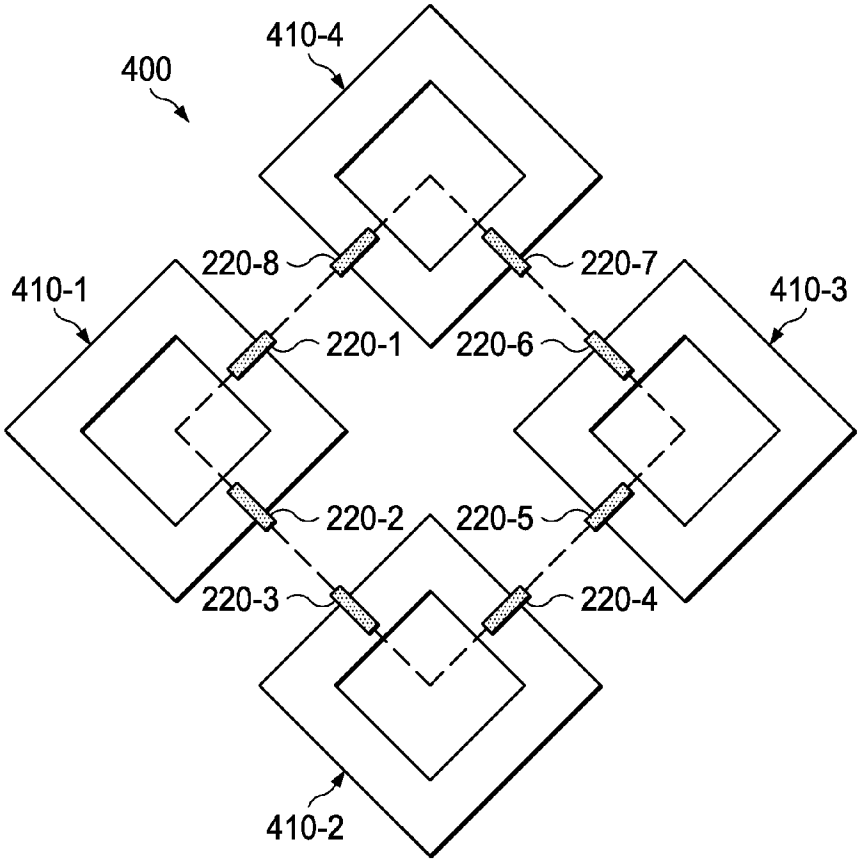
FIG. 4 is an illustrative diagram of yet another embodiment of a dual-polarization antenna element.

FIG. 4 is an illustrative diagram of yet another embodiment of a dual-polarization antenna element 400. Antenna element 400 operates like antenna element 200 of FIG. 2 and antenna element 300 of FIG. 3. Similar in shape to antenna element 300, antenna element 400 includes four radiating elements: element 410-1, element 410-2, element 410-3, and element 410-4. Antenna element 400 also includes feed ports 220-1 through 220-8 of FIGS. 2 and 3. The four radiating elements of antenna element 400 are arranged in a co-planar diamond pattern, as is the case in the embodiments of FIGS. 2 and 3. The four radiating elements are square-ring shaped, having a conductive outer ring and a dielectric inner, similar to those of the embodiment of FIG. 2. The respective volumes of each of the conductive outer rings of the four radiating elements are equal. Feed polls 220-1 through 220-8 are disposed on the conductive outer rings of the four radiating elements. Feed polls 220-1 and 220-2 are disposed on element 410-1, feed polls 220-3 and 220-4 are disposed on element 410-2, feed ports 220-5 and 220-6 are disposed on element 410-3, and feed ports 220-7 and 220-8 are disposed on element 410-4.

Figure 5:
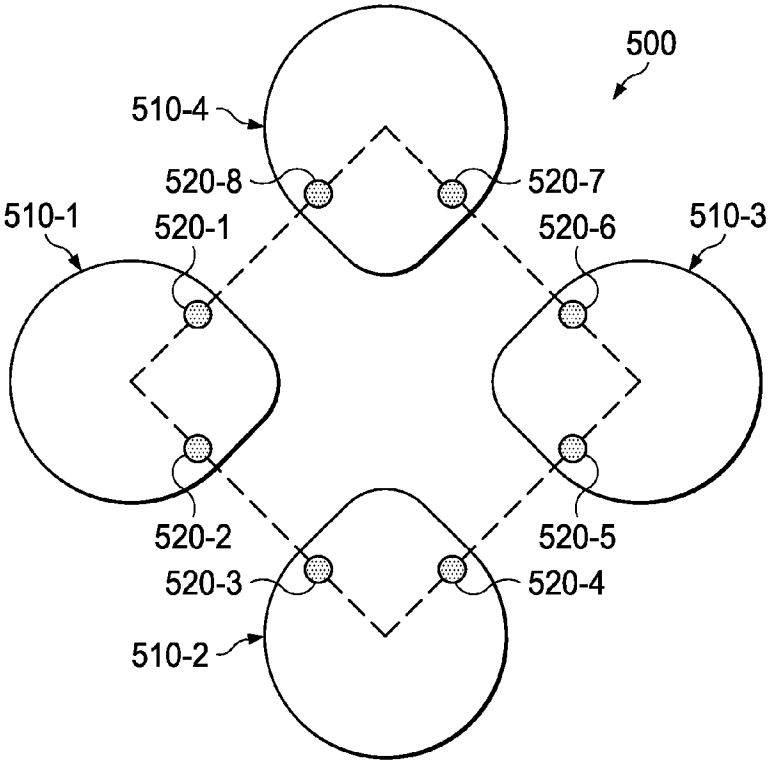
FIG. 5 is an illustrative diagram of another embodiment of a dual-polarization antenna element.

FIG. 5 is an illustrative diagram of another embodiment of a dual-polarization antenna element 500. Antenna element 500 operates like antenna element 200 of FIG. 2, antenna element 300 of FIG. 3, and antenna element 400 of FIG. 4. Antenna element 500 includes four radiating elements: element 510-1, element 510-2, element 510-3, and element 510-4. The four radiating elements are teardrop shaped and arranged in a co-planar diamond pattern similar to those of the embodiments of FIGS. 2, 3, and 4. Each of the four radiating elements includes a narrow end opposite a bulbous end. The four radiating elements are disposed such that the respective narrow ends point toward the center of the co-planar diamond pattern.

Antenna element 500 also includes eight round feed ports arranged in dual-feed pairs, each dual-feed pair being disposed on a respective radiating element of the four radiating elements. Disposed on element 510-1 are feed ports 520-1 and 520-2, disposed on element 510-2 are feed ports 520-3 and 520-4, disposed on element 510-3 are feed ports 520-5 and 520-6, and disposed on element 510-4 are feed ports 520-7 and 520-8. The eight round feed ports operate like the rectangular feed ports of the embodiments of Figurers 2, 3, and 4. Feed ports 520-1 through 520-8 are suitable for coupling to a network, such as a coaxial feed network.

Figure 6A:
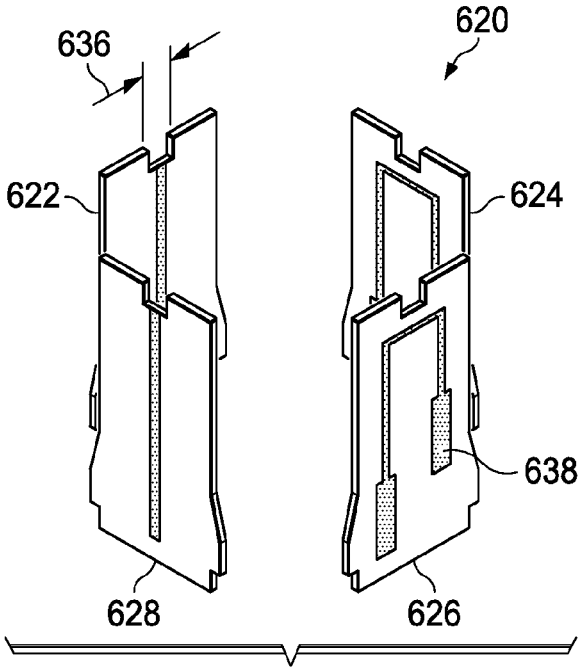
FIGS. 6-A and 6-B are an illustrative diagram of one embodiment of a dual-feed network and a feed circuit.
Figure 6B:
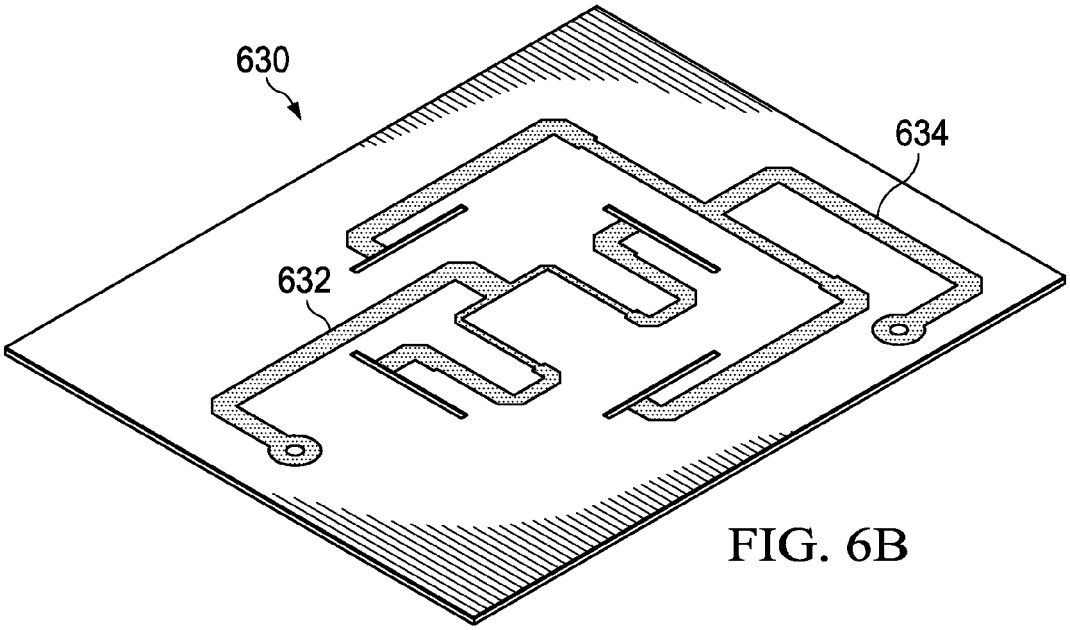

FIGS. 6-A and 6-B are an illustrative diagram of one embodiment of a dual-feed network 620 in FIG. 6-A, and a circuit 630 in FIG. 6-B. Dual-feed network 620 includes feeder PCB 622, feeder PCB 624, feeder PCB 626, and feeder PCB 628. Each of the four feeder PCBs is configured to engage two radiating elements via feed ports in the antenna elements, such as feed ports 220-1 through 220-8 in FIGS. 2, 3, and 4. The four feeder PCBs, when attached to the radiating elements, dictate the spacing between neighboring elements. For example, feeder PCB 622 includes a notch 636 at the top edge where it would engage the radiating elements. The dimensions of notch 636 are a function of the wavelength and target impedance of the radiating elements. In the embodiment of FIGS. 6-A and 6-B, the notch width is $\lambda/32$. The boundaries of notch 636 are conductive and effectively form a parallel-plate capacitor. Each of the four feeder PCBs also includes a conductive trace 638 that couples the two engaged radiating elements. Together, notch 636 and conductive trace 638 can be represented as an LC circuit. The size and shape of notch 636 and conductive trace 638 are designed such that the representative LC circuit has an impedance that matches the target impedance for the radiating elements.

Circuit 630 includes two cross polarized dipole feed circuits, dipole feed circuit 632 and dipole feed circuit 634. When coupled to dual-feed network 620, dipole feed circuit 632 is coupled to feeder PCB 624 and feeder PCB 628, and dipole feed circuit 634 is coupled to feeder PCB 622 and feeder PCB 626.

Figure 7:
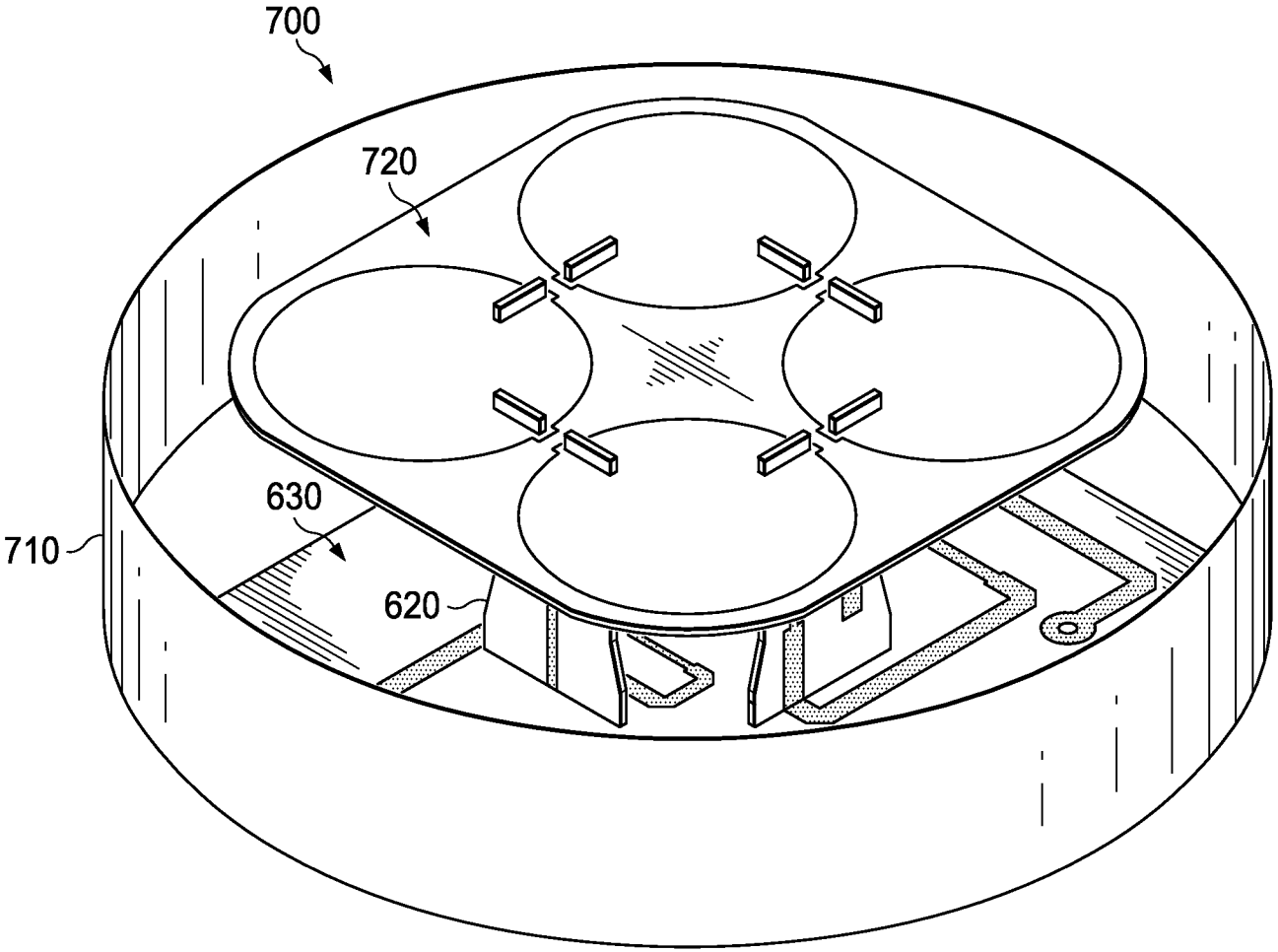
FIG. 7 is an illustrative diagram of one embodiment of a dual-feed dual-polarized UWB antenna.

FIG. 7 is an illustrative diagram of one embodiment of a dual-feed dual-polarized UWB antenna 700. Antenna 700 includes a cylindrical housing 710 that contains an assembly of circuit 630 and dual-feed network 620 of FIGS. 6-A and 6-B, and a UWB antenna element 720. Cylindrical housing 710 can be conductive, providing cross-polarization isolation and −3 dB beamwidth stability over the operating frequency band. As an example, the housing comprises metal-plated cast-plastic. The amount of isolation is adjustable according to the height of cylindrical house 710. UWB antenna element 720 is dual-polarized and is dual-feed, as are the embodiment antenna elements of FIGS. 2, 3, 4, and 5. UWB antenna element 720 includes four shared-element dipole antenna elements, each having two circular radiating elements, similar to antenna element 200 of FIG. 2. Dual-feed network 620 is coupled to UWB antenna element 720 via the eight feed ports respectively disposed on the four radiating elements. Dual-feed network 620 is also coupled to circuit 630, thereby coupling dipole feed circuit 632 to feeder PCB 624 and feeder PCB 628 of FIGS. 6-A and 6-B, and coupling dipole feed circuit 634 to feeder PCB 622 and feeder PCB 626 also of FIGS. 6-A and 6-B.

The embodiment of FIG. 7 illustrates UWB antenna element 720 as that of antenna element 200 of FIG. 2. Referring to the embodiment of FIG. 2, through dual-feed network 620, dipole feed circuit 632 is operable to feed shared-element dipole antenna element 630-2 and shared-element dipole antenna element 630-4. Likewise, dipole feeder circuit 634 is operable to feed shared-element dipole antenna element 630-1 and shared-element dipole antenna element 630-3.

Figure 8:
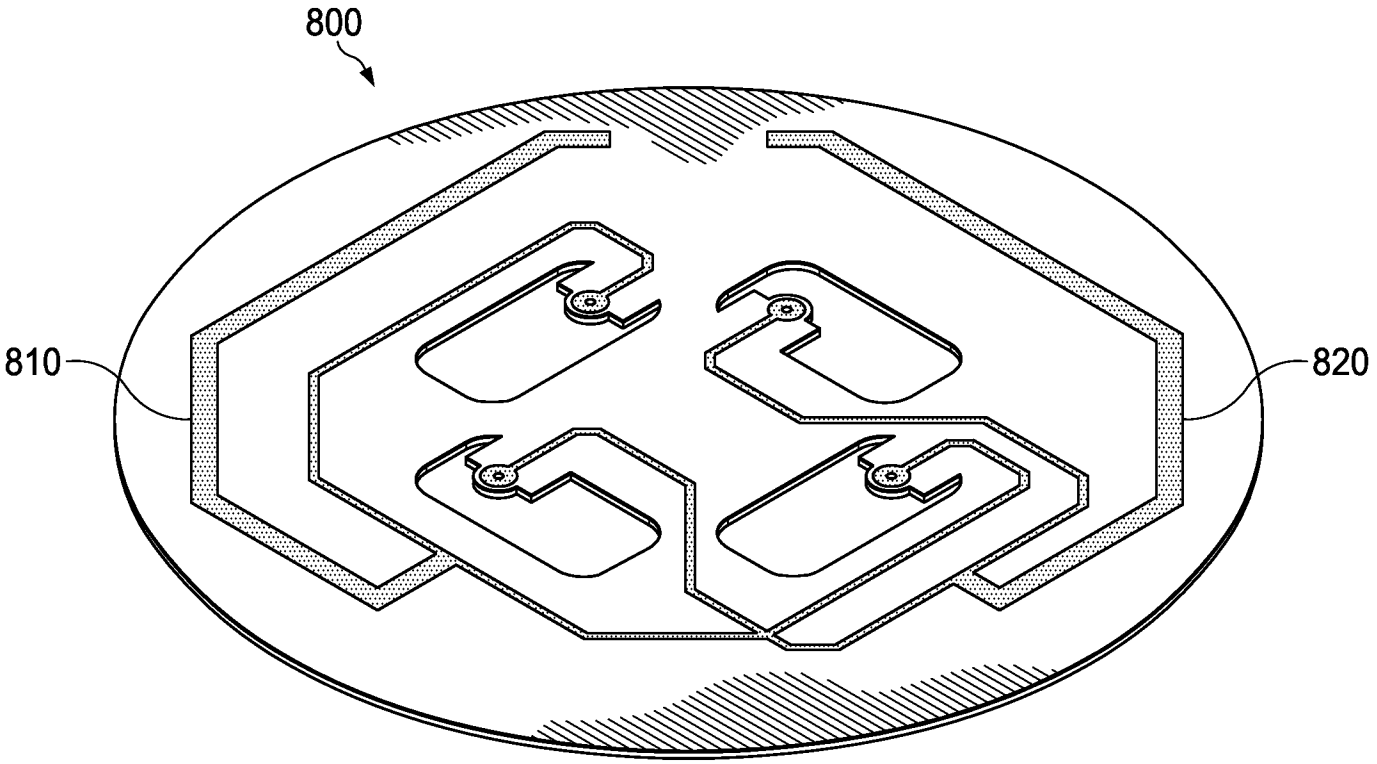
FIG. 8 is an illustrative diagram of another embodiment of a feed circuit.

FIG. 8 is an illustrative diagram of another embodiment of a feed circuit 800. Feed circuit 800 includes a first dipole feed circuit 810 and a second dipole feed circuit 820. Each of the two dipole feed circuits includes a main branch that splits into two smaller branches. The two smaller branches are opposingly disposed on feed circuit 800. First dipole feed circuit 810 and second dipole feed circuit 820 are orthogonal with respect to each other. As in the embodiment of FIG. 6-B, feed circuit 800 is configured to be couplable to a feed network for feeding at least four antenna elements.

Figure 9:
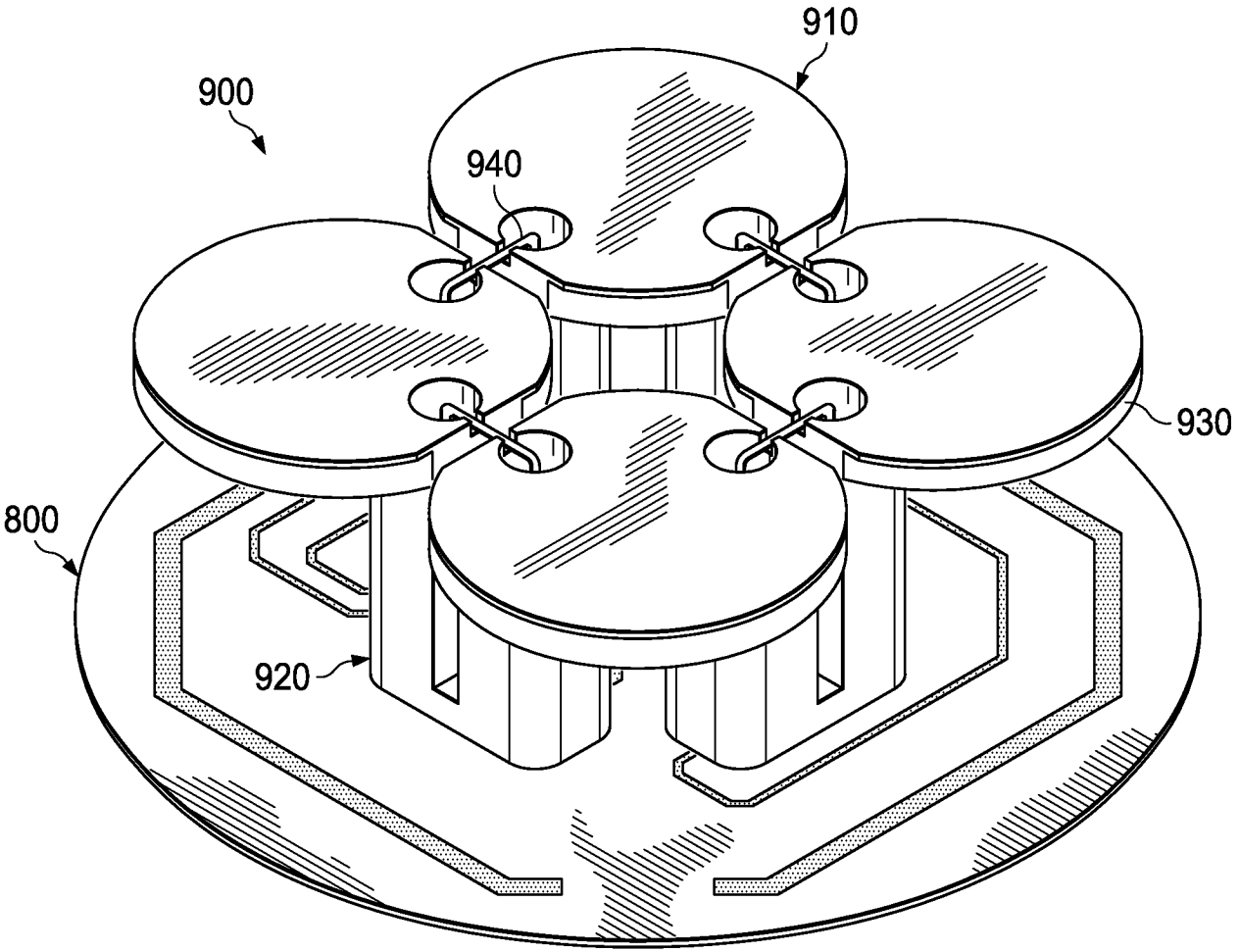
FIG. 9 is an illustrative diagram of another embodiment of a dual-feed dual-polarized UWB antenna.

FIG. 9 is an illustrative diagram of another embodiment of a dual-feed dual-polarized UWB antenna 900. UWB antenna 900 includes feed circuit 800 of FIG. 8 and further includes an element structure 910, a feed structure 920, dielectric layer 930, and a coaxial feed network 940. Element structure 910 includes four radiating elements similar to those in the embodiments of FIGS. 2, 3, 4, and 5. In the embodiment of FIG. 9, element structure 910 is formed of a cast conductive material, such as aluminum. Element structure 910 is cast along with feed structure 920 as a single conductive component. Coaxial feed network 940 is disposed within feed structure 920 and couples element structure 910 to feed circuit 800. Coaxial feed network 940 is a dual-feed network that couples neighboring radiating elements of element structure 910, thereby forming four shared-element dipole antenna elements. The shared-element dipole antenna elements are fed by coaxial feed network 940 through feed structure 920, which couples each radiating element to feed circuit 800.

Beneath element structure 910 is dielectric layer 930. The shape and dimensions of element structure 910 are functions of the wavelength of UWB antenna 900, and are therefore functions of the effective dielectric constant of element structure 910. The addition of dielectric layer 930 beneath element structure 910 effectively increases the dielectric constant of element structure 910, yielding a smaller wavelength and more compact radiating elements. Feed structure 920 is designed to achieve the target impedance for the radiating elements by providing a $\lambda/32$ spacing between neighboring elements. Additionally, the vertical portions of feed structure 920 form parallel plate capacitors, similar to those in feed network 620 in FIG. 6-A, and coaxial feed network 940 creates an inductance. The impedance of each of the four radiating elements can be represented by the corresponding LC circuit.

Figure 10:
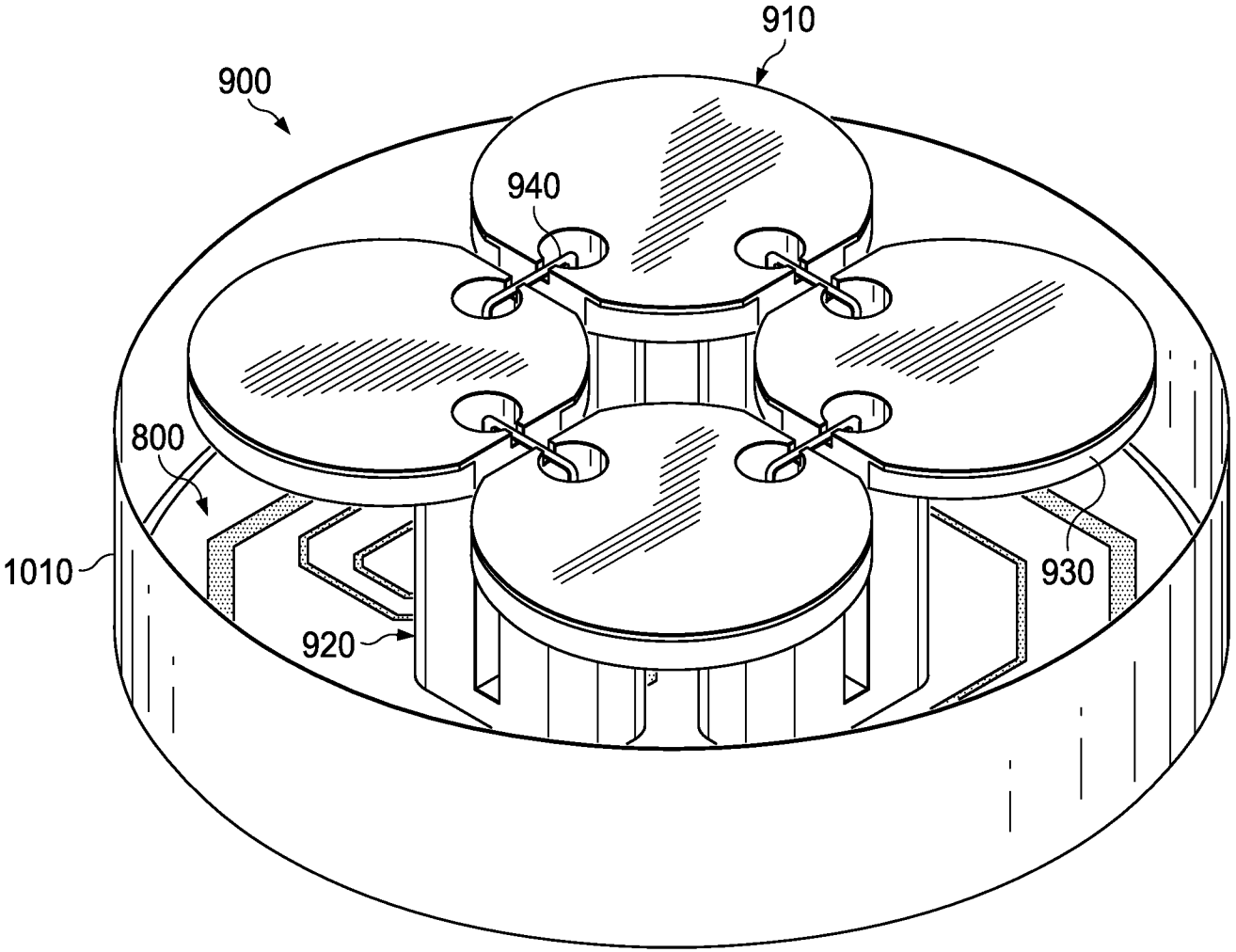
FIG. 10 is an illustrative diagram of another embodiment of a dual-feed dual-polarized UWB antenna.

FIG. 10 is another illustrative diagram of the dual-feed dual-polarized UWB antenna 900 of FIG. 9. UWB antenna 900 includes cylindrical housing 1010, which is similar to cylindrical housing 710 of FIG. 7. Cylindrical housing 1010 contains UWB antenna 900 of FIG. 9, which further includes feed circuit 800, feed structure 920, element structure 910, and dielectric layer 930 attached beneath element structure 910.

Figure 11:
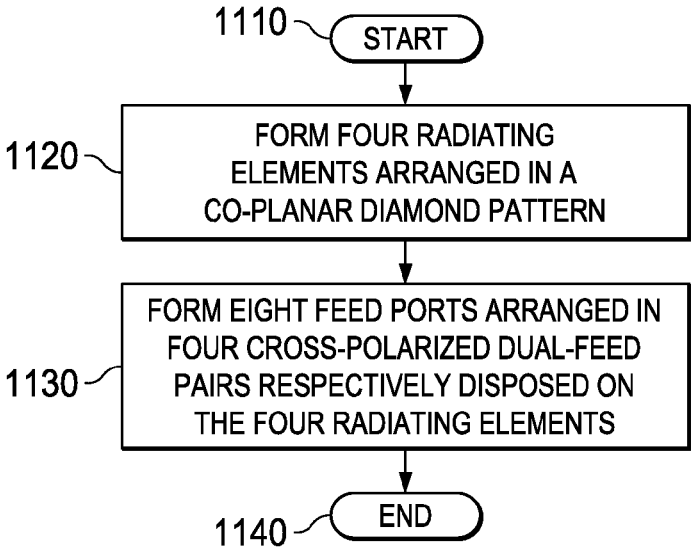
FIG. 11 is a flow diagram of one embodiment of a method of manufacturing a dual-feed dual-polarized antenna element.

FIG. 11 is a flow diagram of one embodiment of a method for manufacturing a dual-feed dual-polarization antenna element. The method begins at a start step 1110. At a first forming step 1120, four radiating elements are formed. The four radiating elements are arranged in a co-planar diamond pattern. Neighboring elements of the four radiating elements form four shared-element dipole antenna elements. Each of the four radiating elements is shared between two cross-polarized dipole antenna elements of the four shared-element dipole antenna elements. In certain embodiments, the four radiating elements are disposed on a PCB. The four radiating elements may be formed in copper, or other material, over a dielectric substrate. Forming the elements over the dielectric substrate can be done by a variety of PCB processes, including both additive and subtractive techniques. In other embodiments, the four radiating elements are composed of cast aluminum. Cast aluminum radiating elements can also include a cast aluminum feed network, the elements and feed network being formed in a single cast aluminum component. Additionally, in some embodiments, the cast aluminum radiating elements have a dielectric layer attached on the underside of each of the elements. The dielectric layer, for a given operating frequency band, allows more compact antenna elements via a reduced wavelength due to the modified effective dielectric constant.

At a second forming step 1130, eight feed ports are formed. The eight feed ports are arranged in four cross-polarized dual-feed pairs. The pairs are respectively disposed on the four radiating elements. Each feed port of the four cross-polarized dual-feed pairs is operable to respectively excite one of the four radiating elements for a cross-polarized one of the four shared-element dipole antenna elements. The size and locations of the feed ports on each of the radiating elements are determined according to the wavelength and the target impedance. Additionally, the type of feed network to which the dual-feed dual-polarization antenna element is couplable dictates the shape of the feed ports. For example, in embodiments for use with a coaxial feed network, the feed ports should be circular. In embodiments for use with a PCB feed network, the feed ports are typically rectangular slots. Feed ports can be formed on the radiating elements by removing the conductive and any dielectric material that may be present at the feed port site. For example, in embodiments where the radiating elements are formed on a PCB, the feed ports are formed by cutting or drilling through the copper and substrate, leaving an opening through which a PCB feed network can couple, or through which a coaxial feed network can couple. In embodiments having cast aluminum radiating elements, the feed ports are specified in the cast and are formed concurrently with the radiating elements. In embodiments having a single component cast aluminum feed network and radiating elements, the radiating elements, feed network, and ports are all cast concurrently. The method then ends at an end step 1140.

While this invention has been described with reference to illustrative embodiments, this description is not intended to be construed in a limiting sense. Various modifications and combinations of the illustrative embodiments, as well as other embodiments of the invention, will be apparent to persons skilled in the art upon reference to the description. For example, instead of having four radiating members, it is possible to have any multiple of four (eight, twelve, sixteen, twenty, for example) arranged in substantially a similar way as the four members radiating illustrated herein. It is therefore intended that the appended claims encompass any such modifications or embodiments.

What is claimed is:

1. A dual-polarization antenna element, comprising:

four shared-element dipole antenna elements comprising four single radiating elements, arranged in a co-planar diamond pattern, wherein each shared-element dipole antenna element comprises two neighboring elements of the four single radiating elements, and wherein each of the four single radiating elements is shared between two cross-polarized dipole antenna elements of the four shared-element dipole antenna elements; and eight feed ports arranged in four cross-polarized dual-feed pairs, wherein each cross-polarized dual-feed pair is disposed on a respective one of the four single radiating elements, and wherein each feed port on the four single radiating elements excites at least one of the cross-polarized dipole antenna elements.

2. The dual-polarization antenna element of claim 1 wherein respective radiating elements and feed ports of the four shared-element dipole antenna elements are disposed to produce plus-or-minus 45 degree slant polarization.

3. The dual-polarization antenna element of claim 1 wherein respective radiating elements and feed ports of the four shared-element dipole antenna elements are disposed to produce horizontal and vertical polarization.

4. The dual-polarization antenna element of claim 1 wherein each of the four single radiating elements are sized according to a wavelength for the dual-polarization antenna element.

5. The dual-polarization antenna element of claim 4 wherein each of the four shared-element dipole antenna elements comprises a polarized half-wavelength dipole antenna element.

6. The dual-polarization antenna element of claim 1 wherein the eight feed ports are slots and configured to couple to a printed circuit board feed network.

7. The dual-polarization antenna element of claim 1 wherein the eight feed ports are round and configured to couple to a coaxial feed network.

8. The dual-polarization antenna element of claim 1 wherein the co-planar diamond pattern is in a plane of an electric field that the dual-polarization antenna element is operable to radiate.

9. The dual-polarization antenna element of claim 1 wherein the four single radiating elements are operable to radiate at a frequency in a band of 1710 megahertz to 2700 megahertz.

10. The dual-polarization antenna element of claim 1 wherein the four single radiating elements are square-ring shaped.

11. The dual-polarization antenna element of claim 1 wherein the four single radiating elements are circle shaped.

12. The dual-polarization antenna element of claim 1 wherein the four single radiating elements are disposed on a printed circuit board.

13. A dual-feed dual-polarized ultra-wideband (UWB) antenna, comprising:

four shared-element dipole antenna elements comprising four single radiating elements, arranged in a co-planar diamond pattern, including two shared-element dipole antenna elements cross-polarized with respect to two other shared-element dipole antenna elements, wherein each shared-element dipole antenna element is composed of two neighboring radiating elements of the four single radiating elements, each of the four single radiating elements is shared with a respective cross-polarized shared-element dipole antenna element of the four shared-element dipole antenna elements;

a dual-feed network having four feeds, wherein each feed is coupled to a respective neighboring pair of radiating elements of the four single radiating elements, and wherein each of the four single radiating elements is coupled to two respective cross-polarized feeds of the four feeds; and a circuit having first and second dipole feed circuits, wherein the first dipole feed circuit is coupled to a first pair of similarly polarized feeds, wherein the second dipole feed circuit is coupled to a second pair of similarly polarized feeds, and wherein the first pair of similarly polarized feeds is orthogonal to the second pair of similarly polarized feeds.

14. The dual-feed dual-polarized UWB antenna of claim 13 wherein a unitary structure comprises the four single radiating elements and the dual-feed network, and wherein the unitary structure is cast aluminum.

15. The dual-feed dual-polarized UWB antenna of claim 13 wherein the four single radiating elements are disposed on a printed circuit board.

16. The dual-feed dual-polarized UWB antenna of claim 13 further comprising a housing coupled to and at least partially enclosing the circuit, the dual-feed network, and the four single radiating elements.

17. The dual-feed dual-polarized UWB antenna of claim 16 wherein the housing comprises metal and has a shape having four-fold symmetry.

18. The dual-feed dual-polarized UWB antenna of claim 16 wherein the housing is a plastic casting that is plated with a metal.

19. The dual-feed dual-polarized UWB antenna of claim 16 wherein the housing is a cylindrical conducting housing disposed such that a circular cross section of the cylindrical conducting housing is parallel to the co-planar diamond pattern.

20. The dual-feed dual-polarized UWB antenna of claim 19 wherein the cylindrical conducting housing is cast aluminum and has dimensions according to a wavelength of the dual-feed dual-polarized UWB antenna.

21. The dual-feed dual-polarized UWB antenna of claim 13 wherein the four single radiating elements are square-ring shaped.

22. The dual-feed dual-polarized UWB antenna of claim 13 wherein each of the four feeds is composed of a printed circuit board (PCB) having a conductive trace configured to respectively couple neighboring pairs of radiating elements of the four single radiating elements.

23. The dual-feed dual-polarized UWB antenna of claim 13 wherein the dual-feed network is operable to excite each of the four single radiating elements, thereby causing each of the four single radiating elements, in combination with respective neighboring radiating elements of the four single radiating elements, to radiate two cross-polarized electric fields.

24. A method of manufacturing a dual-feed dual-polarized antenna element, comprising:

forming four single radiating elements, arranged in a co-planar diamond pattern, wherein each two neighboring radiating elements of the four single radiating elements form four shared-element dipole antenna elements, and wherein each of the four single radiating elements is shared between two cross-polarized dipole antenna elements of the four shared-element dipole antenna elements; and forming eight feed ports arranged in four cross-polarized dual-feed pairs, wherein each cross-polarized dual feed pair is disposed on a respective one of the four single radiating elements, and wherein each feed port on the four single radiating elements is disposed to excite at least one of the cross-polarized dipole antenna elements.

25. The method of claim 24 wherein the forming the four single radiating elements includes forming the four single radiating elements in a conductive metal.

26. The method of claim 25 wherein the forming the four single radiating elements includes enclosing a plastic substrate with a conductive metal.

27. The method of claim 25 wherein the forming the four single radiating elements includes forming the four single radiating elements in copper over a dielectric substrate.

28. The method of claim 27 wherein the forming the eight feed ports includes respectively creating two copper-lined holes in each of the four single radiating elements, wherein each set of two copper-lined holes corresponds to one of the four cross-polarized dual-feed pairs, and wherein each copper-lined hole is couplable to a coaxial feed network.

29. The method of claim 27 wherein the forming the eight feed ports includes respectively creating two orthogonal slots in each of the four single radiating elements, wherein each set of two orthogonal slots corresponds to one of the four cross-polarized dual-feed pairs, and wherein each orthogonal slot is couplable to a printed circuit board (PCB) feed network.

30. The method of claim 25 wherein the forming the four single radiating elements includes casting four aluminum single radiating elements as a single component.

31. The method of claim 30 further comprising attaching a dielectric layer to an underside of the four aluminum single radiating elements.

32. The method of claim 30 wherein the casting the single component includes casting a coaxial feed network coupled to the four aluminum single radiating elements.

33. The method of claim 24 wherein the forming the eight feed ports includes enclosing a cast-plastic feed network with a conductive metal.

* * * * *